US006108956A

United States Patent [19]

Conway et al.

[11] Patent Number: 6,108,956

[45] Date of Patent: Aug. 29, 2000

[54] TRI-MOUNT SIGN SYSTEM

[75] Inventors: Thomas M. Conway, Chicago; Scott Padiak, Winnetka, both of Ill.

[73] Assignee: Cormark, Inc., Ill.

[21] Appl. No.: 09/054,732

[22] Filed: Apr. 3, 1998

[51] Int. Cl.[7] ..... G09F 3/20

[52] U.S. Cl. ..... 40/651; 40/606; 248/220.41

[58] Field of Search ..... 40/606, 651; 248/220.41, 248/220.42; 108/108

[56] References Cited

U.S. PATENT DOCUMENTS

| | | | |
|---|---|---|---|
| Re. 30,734 | 9/1981 | Eckert . | |
| 268,616 | 12/1882 | Brown . | |
| 1,111,458 | 9/1914 | Hight . | |
| 1,220,758 | 3/1917 | Lamphiear . | |
| 1,559,010 | 10/1925 | Schwieger . | |
| 1,793,563 | 2/1931 | Schwartz . | |
| 1,866,723 | 7/1932 | Powers . | |
| 2,646,241 | 7/1953 | McLean . | |
| 2,787,433 | 4/1957 | Slavsky et al. . | |
| 2,845,729 | 8/1958 | Baumgart . | |
| 3,082,989 | 3/1963 | Bower . | |
| 3,102,351 | 9/1963 | Howell . | |
| 3,529,798 | 9/1970 | Williams et al. . | |
| 3,669,392 | 6/1972 | Saunders . | |
| 3,969,838 | 7/1976 | Moore . | |
| 4,344,244 | 8/1982 | Tyke . | |
| 4,369,948 | 1/1983 | Krauss et al. . | |
| 4,531,311 | 7/1985 | Howard et al. . | |
| 4,574,507 | 3/1986 | Elliott . | |
| 4,593,486 | 6/1986 | Visocky et al. . | |
| 4,616,799 | 10/1986 | Rebentisch . | |
| 4,709,891 | 12/1987 | Barnett . | |
| 4,729,183 | 3/1988 | Tarter et al. . | |
| 4,791,739 | 12/1988 | Hetzer . | |
| 4,798,013 | 1/1989 | Sainato . | |
| 4,805,331 | 2/1989 | Boggess et al. . | |
| 4,821,437 | 4/1989 | Abramson et al. . | |
| 4,866,867 | 9/1989 | Clark . | |
| 4,869,376 | 9/1989 | Valiulis et al. . | |
| 4,881,707 | 11/1989 | Garfinkle . | |
| 4,884,351 | 12/1989 | Abramson . | |
| 4,909,464 | 3/1990 | Levine et al. . | |
| 4,957,256 | 9/1990 | Boeding . | |
| 5,106,046 | 4/1992 | Rowles et al. . | |
| 5,111,606 | 5/1992 | Reynolds . | |
| 5,189,822 | 3/1993 | Schmanski et al. . | |
| 5,230,174 | 7/1993 | Reed . | |
| 5,237,767 | 8/1993 | Kringel et al. . | |
| 5,383,793 | 1/1995 | Hsu et al. . | |
| 5,408,775 | 4/1995 | Abramson et al. . | |
| 5,419,134 | 5/1995 | Gibson | 40/606 |
| 5,472,289 | 12/1995 | Kringel et al. . | |
| 5,718,072 | 2/1998 | Garfinkle | 40/606 |
| 5,722,625 | 3/1998 | Kenney | 248/220.41 |
| 5,832,644 | 11/1998 | Mason | 40/606 |
| 5,924,367 | 7/1999 | Henke et al. | 40/651 |

*Primary Examiner*—C. Davis
*Attorney, Agent, or Firm*—Welsh & Katz, Ltd.

[57] ABSTRACT

A mounting system for mounting a sign, such as a sheet or a panel to a shelf system having a pair of support posts and a shelf extending transverse to the support posts, includes a display portion having first and second generally parallel, spaced apart runners connected to one another by a pair of spaced apart connecting members defining a sign receiving region. The display portion includes at least one of a shelf mounting bracket receiving region, a wall surface mounting bracket receiving region and a wall top mounting bracket receiving region. The shelf mounting bracket receiving region includes a pivoting element for pivotally mounting the display portion to a shelf mounting bracket for pivoting the display portion between a first position and a second position. The display portion is maintained in the first position by releasable engagement of the display portion with the shelf mounting bracket. The wall surface mounting bracket receiving region includes an elongated opening in at least one of the connecting members intermediate the runners. The opening extends along a portion of the connecting member and is adapted to receive a wall surface mounting bracket. The wall top mounting bracket receiving region includes a notch in one of the runners at an end thereof. The notch extends along a portion of the runner and is adapted to receive a wall top mounting bracket. A shelf mounting bracket is used to mount the display portion to the shelf. The wall surface and wall top mounting brackets are used to mount the display portion between the pair of support posts.

18 Claims, 3 Drawing Sheets

10
12
14
16
16a
18
20
22
24
26
28
30
32
34
36
38
40
42
44
46
48
50
52
54
56
58
60
62
64
66
68
70

SALE
SALE
22
24
28
30
32
34
70
72
74
76
78
80
102
104
106
108

TRI-MOUNT SIGN SYSTEM

FIELD OF THE INVENTION

The present invention pertains to a sign mounting system. More particularly, the invention pertains to a sign mounting system for mounting a sign to a shelf, a shelf partition wall face, and a shelf partition wall top.

BACKGROUND OF THE INVENTION

Point-of-purchase displays and signs have become extremely popular in all manner of retail trades. Such signs can be particularly effective marketing tools when properly designed and utilized.

An extremely large number of different types of such point-of-purchase displays exist. These displays vary from the active-type, such as rotating signs for eyeglasses and the like, to commonly known passive types of signs such as overhead display signs. In a well-recognized arrangement, the signs are positioned on the shelves on which the goods are stocked, or on the vertical standards that support the shelves. In this manner, the signs are used to direct consumers' attention to the particular goods or items that are on the shelves.

One effective way to direct consumers' attention to particular goods or items is to place the signs at the front of the shelves, on top of partition walls supporting the shelves or on the face of such partition walls. One known type of sign that is positioned near the goods to be displayed, is permanently affixed to the shelf front. While such a sign is effective at directing consumers' attention to particular items or products that are located on the shelf, because the sign is permanently affixed to the shelf, it can create difficulty in restocking the shelf. Additionally, permanently affixed signs can be easily damaged if due care is not exercised when restocking the shelves.

Another known type of sign system includes a mounting portion that is permanently affixed to, for example, a vertical shelf standard, and includes an arm that extends out from the mounting bracket and has a pivoting head at the end of the arm. The sign is mounted to the pivoting head to permit the sign to be moved out of the way during shelf restocking. One major drawback to this particular sign arrangement is that there are many small hardware items that are necessary for assembling the sign, and many of the hardware items must be removed in order to pivot the sign out of the way from its normal, display position to the restocking position to restock the shelf.

In many known shelving arrangements, the shelves extend from vertical supports posts having partition walls extending between and connecting the posts. The shelves rest on brackets or supports that extend from both sides of the face of the partition walls. Various different types of point-of-purchase display systems are known for these shelving systems. One particular kind of sign is mounted to the vertical supports or the face of the partition wall behind the shelves. Another known type of sign extends upwardly from the top of the partition walls at a height above the floor that provides increased visibility over greater distances.

While these sign systems can be effective in directing consumers' attention to a particular product or shelf location, such systems suffer from a variety of drawbacks. First, as with the shelf mounted signs discussed above, these sign systems are relatively inflexible in that they cannot be installed in more than one manner on a particular shelving system. In addition, because of the differences between such sign systems, the installation hardware for these systems typically varies from one system to the next and does not permit interchangeability. As will be recognized by users of such sign systems, these drawbacks can result in increased costs for maintaining a large quantity of different sign types and their respective mounting hardware, and can also result in not having on-hand the proper signage to, for example, advertise a sale or special item.

Accordingly, there is a need for a flexible sign mounting system that permits a sign to be mounted to commonly used shelving systems in a variety of configurations. Desirably, such a sign system permits a sign to be mounted to the front and/or horizontal surface of a shelf, as well as to the face of a partition wall backing for the shelf, and the top of such a partition wall. Most desirably, such a shelving system utilizes common components among the different types of installation arrangements, and permits the signs to be installed with minimal hardware and tools.

SUMMARY OF THE INVENTION

A mounting system provides for mounting a sign, such as a sheet or a panel, to a shelf system having support posts and at shelves extending from the posts. The system permits mounting the sign to a shelf front or on the support posts at the face of a partition wall that extends between the posts or to the top of the posts.

The mounting system includes a display portion having first and second generally parallel, spaced apart runners connected to one another by a pair of spaced apart connecting members. The runners and connecting members define a frame or sign receiving region. The display portion includes at least one of a shelf mounting bracket receiving region, a wall surface mounting bracket receiving region and a wall top mounting bracket receiving region. The system further includes a shelf mounting bracket, a wall surface mounting bracket and/or a wall top mounting bracket.

The shelf mounting bracket receiving region includes a pivoting element for pivotally mounting the display portion to the shelf mounting bracket for pivoting the display portion between a first position and a second position. The display portion is maintained in the first position by releasable engagement of the display portion with the shelf mounting bracket.

The wall surface mounting bracket receiving region includes an elongated opening in at least one of the connecting members intermediate the runners. The opening extends along a portion of the connecting member and is adapted to receive the wall surface mounting bracket. The wall top mounting bracket receiving region includes a notch in one of the runners at an end thereof. The notch extends along a portion of the runner and is adapted to receive the wall top mounting bracket.

Advantageously, the present tri-mount system permits the use of a single display portion that is configured for use in any of the three aforementioned mounting configurations. That is, the same display portion can be used as either a shelf front sign, a partition wall surface sign or a partition wall top sign. Moreover, the mounting brackets are interchangeable between signs, as are the signs interchangeable among mounting brackets. The sign mounting system can thus provide a considerable cost savings over known sign mounting systems.

In addition, the present system requires no additional hardware for mounting a sign in any of the three configurations. That is, unlike known sign systems that require additional hardware, the present tri-mount system requires only the mounting brackets to install the display portion to a shelf system. Moreover, using the present tri-mount system, signs can be installed without tools. The various mounting brackets of the present system lock onto shelves and engage support posts by frictional and snap-lock cantilever arrangements such that no tools are necessary for installation. This greatly reduces the time necessary and attendant costs for producing creative and "attention-getting" merchandising displays.

A preferred mounting arrangement includes a shelf mounting bracket having a shelf rest that rests on, or lies adjacent the shelf. The rest includes engaging projections at an end thereof for engaging the shelf and a hinge that pivotally mounts the display portion thereto for pivoting the display portion between the first position and the second position. Preferably, the hinge is formed on a hinge arm that extends generally transversely from the rest, and is operably connected to the display portion at one of the first and second runners.

To lock the display portion into the first position, a tab can extend from one of the connecting members, and the shelf mounting bracket can include a display engaging member for engaging the tab. In this manner, the display portion is releasably locked to the bracket when it is in the first position. The tab and display engaging member are releasable from one another to pivot the display portion to the second position. For ease of releasing the display portion, the display engaging member is readily accessible and extends through an opening formed in the connecting member.

In a preferred configuration, the rest includes at least one, and more preferably a plurality of engaging projections, at least one of which is a locking projection. The projections are adapted to insert and lock into corresponding openings in the shelf to define a cantilever retaining arrangement of the bracket on the shelf. The bracket can further include a shelf hook that extends from the rest for releasably locking the bracket to the shelf.

The wall surface mounting bracket is adapted to mount the display portion to the support posts. The wall surface bracket includes a main body having at least two projections extending from a side of the body for inserting and locking into corresponding openings in the support posts. Display engaging elements extend from an opposing side of the body and are configured to releasably, lockingly engage the display portion to secure the display portion to the posts. Preferably, the display engaging elements have an arcuate shape to facilitate engaging the display portion to the bracket.

In a most preferred wall surface mounting arrangement, the bracket includes a pair of substantially identical display engaging elements spaced from one another and adapted to releasably, lockingly engage two display portions in side-to-side relation to one another.

The wall top mounting bracket is used to mount the display portion to the support posts at the top of the posts. The wall top mounting bracket has a main body and at least two projections extending from an end of the body for inserting and locking into corresponding openings in the support posts. A display engaging element extends from an opposing end of the body and is configured to engage the display portion to secure the display portion to the top of the posts.

Preferably, the wall top mounting bracket includes a pair of substantially identical display engaging elements spaced from one another. Similar to the wall surface mounting brackets, the engaging elements of the top mount are configured to engage two display portions in side-to-side relation to one another.

Other features and advantages of the present invention will be apparent from the following detailed description, in conjunction with the accompanying drawings, and the appended claims.

DETAILED DESCRIPTION OF THE PREFERRED EMBODIMENTS

Figures 1, 2, 3, 4:
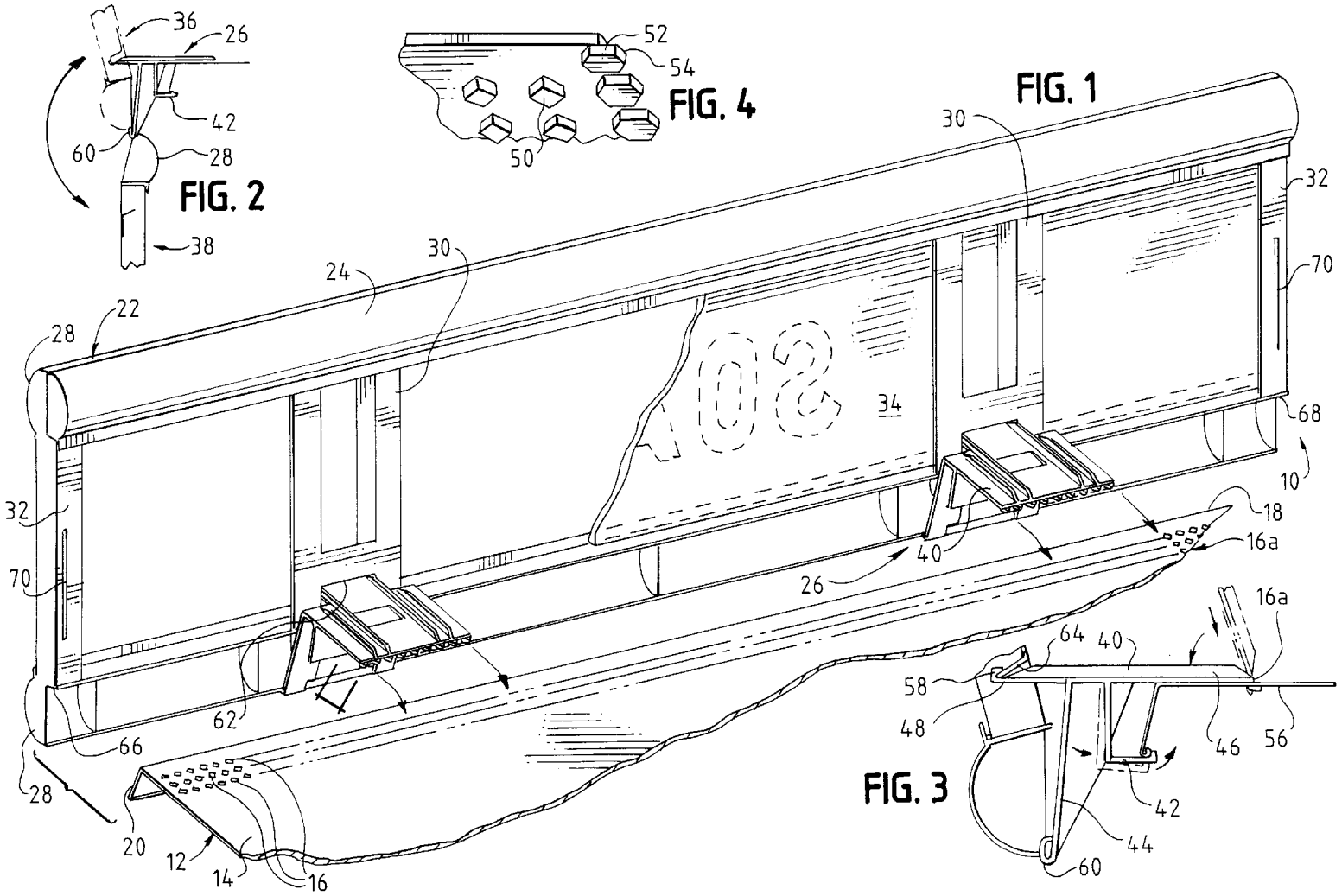
FIG. 1 is a rear perspective view of a tri-mount sign system embodying the principles of the present invention, this sign being shown pivoted upwardly to the display position.
FIG. 2 is a side view of the tri-mount sign system of FIG. 1, with the sign illustrated in both the display and the storage positions.
FIG. 3 is a partial side view of the sign system illustrating the shelf mount arrangement, and illustrated with the sign in the display position.
FIG. 4 is a bottom perspective view of the shelf engaging projections of the shelf mounting bracket used for the shelf mounting arrangement.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now the figures and in particular to FIG. 1, there is shown one embodiment of a tri-mount sign system 10 embodying the principles of the present invention. The sign mount system 10 is shown in a rear perspective view, exploded relative to the shelf 12 to which the sign is mounted. The shelf 12 includes a relatively flat horizontal surface 14 having a plurality of openings 16 therein at about a front edge 18 of the shelf 12, and a lip 20 that extends downwardly, transverse to the horizontal surface 14.

The sign mount system 10 includes, generally, a display portion 22, one or more semi-tubular finishing elements 24, and a mounting bracket, such as the exemplary shelf mounting bracket 26 illustrated in FIGS. 1–4. The shelf mounting bracket 26 is used to support the display portion 22 when used as a shelf 12 front display.

The display portion 22 includes a pair of parallel, spaced apart, semi-tubular runner portions 28 and a plurality of transverse connecting members 30 extending between the runners 28 intermediate the ends thereof. Additional connecting members that define a pair of end rails 32 extend generally parallel to the connecting members 30 at about the respective ends of the semi-tubular runners 28. A sign 34, such as the exemplary sheet or panel, is affixed to the display portion 22 extending between the runners 28 and the end rails 32. In the embodiment of the system 10 illustrated in FIG. 1, the finishing element 24, which is semi-tubular in cross-section, similar to the runners 28, is mounted to the back of one of the runners 28 to provide a finished look to the display portion 22.

The shelf mounting bracket 26 permits the display portion 22 to be pivotally mounted to a shelf 12 front so that the display portion 22 can be pivoted is between a first position as indicated at 36 in FIG. 2 and as illustrated in FIG. 3, and a second position as indicated at 38 in FIG. 2. In a contemplated mounting arrangement, the first position 36 is used as a display orientation and the second position 38 is used as a restocking or storage orientation to facilitate restocking the shelf 12 on which the display portion 22 is mounted. It will, however, be recognized by those skilled in the art that other orientations are contemplated by use of the present system 10, which other orientations are within the scope of the present invention.

The shelf mounting bracket 26 includes a generally planar shelf rest 40 that rests on, e.g., lies adjacent, and engages the shelf 12, a shelf hook 42 that extends generally transversely from the rest 40, and a display hinge arm 44 that also extends generally transversely from the rest 40 in substantially the same direction as the shelf hook 42. The hook 42 and hinge arm 44 extend from the rest 40 intermediate first and second ends, 46, 48, respectively.

Referring now to FIG. 4, a plurality of shelf engaging projections 50 extend from the rest first end 46, generally transversely thereto, and are configured to engage the holes or openings 16 in the shelf 12. In this manner, when the projections 50 are engaged with the shelf openings 16 and the hook 42 is positioned over the shelf lip 20, the shelf mounting bracket 26 is secured in place on the shelf 12 front. The projections 50 that extend from the bracket rest 40 include locking projections 52 that extend outwardly beyond the rest first end 46 and define cantilever portions 54. This arrangement provides for locking the rest 40 onto the shelf 12 when the projections 50, 52 are engaged with the shelf 12.

As will be apparent from the drawings, when the projections 50, 52 are inserted into the shelf openings 16, the locking projections 52 extend beyond the openings 16 and engage a bottom surface 56 of the shelf 12. These locking projections 52 provide a cantilever locking arrangement that maintains the rest first end 46 engaged with the shelf 12 while the shelf hook 42 maintains the second end 48 of the rest 40 in engagement with the shelf 12.

A display engaging member 58 is disposed at the rest second end 48 in opposing relation to the projections 50, 52. The engaging member 58 is configured to engage the display portion 22, preferably at the connecting members 30, to maintain the display portion 22 in the first, e.g., display position 36, as illustrated in FIG. 3. The hinge arm 44 includes a hinge 60 about which the display portion 22 rotates or pivots and defines an axis of rotation A. The display portion 22 can be pivoted from the display position 36 to the second, e.g., restocking position 38, so that the shelf 12 on which the display 22 is mounted can be readily restocked without having to reach over, and possibly damaging the display 22.

Referring now to FIGS. 1 and 3, it can be seen that the connecting members 30 each include an opening 62 therein and a tab 64 extending from the member 30 into the opening 62. Respective display engaging members 58 extend through these openings 62 and engage or lock into the tabs 64 to maintain the display portion 22 in the display position 36. The engaging members 58 and tabs 64 releasably lock into one another so that the display portion 22 can be readily pivoted from the display position 36 into the restocking position 38.

FIG. 3 illustrates installation of the shelf mounting bracket 26 onto the shelf 12. The mounting bracket 26 is positioned above the shelf 12, at an angle so as to engage the locking projections 52 with a linear arrangement of shelf openings, as indicated at 16*a*. The locking projections 52 are inserted into the shelf openings 16*a*so that the cantilever portions 54 of the projections 52 lie adjacent the shelf bottom surface 56. The bracket 26 is rotated downwardly so that the other, non-cantilever projections 50 engage the shelf openings 16. The shelf hook 42 is then engaged with the shelf lip 42 to lock the mounting bracket 26 in place. Because the locking projections 52 extend beyond the openings 16*a* and engage the bottom surface 56, the mounting bracket 26 is retained in place by the cantilever effect.

Still referring to FIG. 3, the display portion 22 is then locked into the display position 36 by engagement of the display engaging members 58 with the tabs 64 that extend from the connecting members 30. To rotate or pivot the display portion 22 into the restocking position 38, the rest second ends 48, at about the engaging members 58 are urged downward, out of engagement with their respective tabs 64, and the display portion 22 is pivoted downwardly as shown at 38 in FIG. 2, to restock the shelf 12. To again reposition the display portion 22 in the display position 36, the display 22 is rotated upwardly to the display position 36 until the engaging members 58 and tabs 64 engage one another. It is anticipated that engagement of the engaging members 58 and tabs 64 will be visually apparent and audibly apparent by a "clicking" sound as the tabs 64 and members 58 lock into one another.

Figures 5, 6, 7:
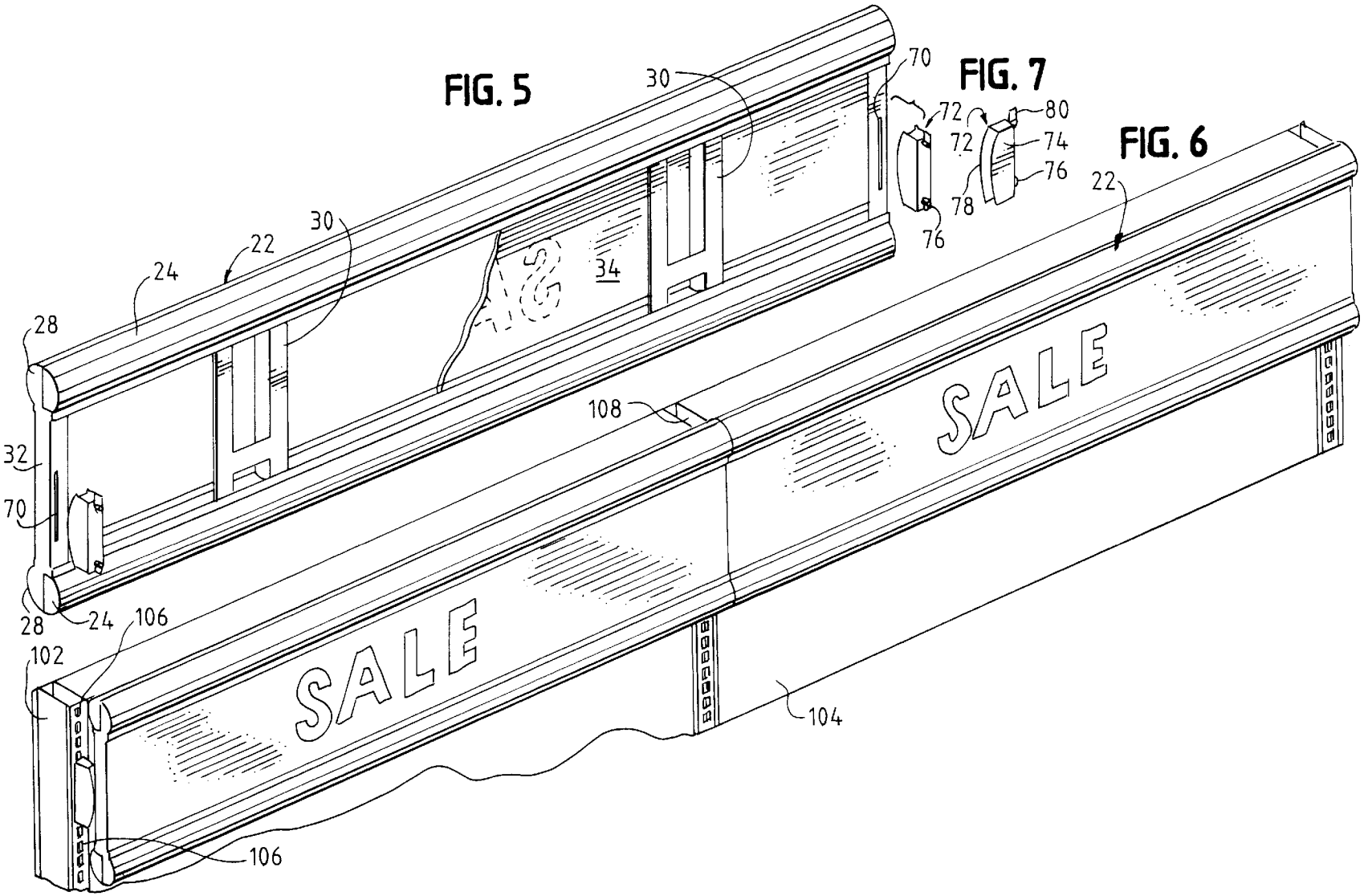
FIG. 5 is a rear view of the tri-mount sign system showing the partition wall surface mounting bracket in an exploded arrangement.
FIG. 6 is a perspective illustration of a pair of signs mounted to the surface of a partition wall in side-to-side relation to one another.
FIG. 7 illustrates a partition wall surface mounting bracket.

FIGS. 5 through 7 illustrate an embodiment of the tri-mount display system in which the display portion 22 is mounted to the vertical support members or posts 102 of a partition wall 104, such as a display wall. As can be seen both from FIGS. 1 and 5, the end rails 32 of the display portion 22 include elongated slots or openings 70 that extend generally parallel to the axis of the end rails 32. The slots 70 are configured to engage a wall surface mounting bracket 72 that extends between the support posts 102 and the display portion 22. The wall surface mounting brackets 72 include a main body portion 74 having projections 76 extending from a side thereof that are adapted to engage openings 106 in the support posts 102.

Display engaging elements 78 extend from an opposing side of the main body portion 74 and are adapted to engage and lock into the elongated slots 70 in the end rails 32. The display engaging elements 78 can frictionally engage rails 32 at the slots 70, or the elements 78 can include slots (not shown) extending along a portion of each element's base to lock into the display portion 22.

In a presently preferred embodiment, the projections 76 that extend from the main body portion 74 are configured similar to the projections 50, 52 extending from the rest portion 40 of the shelf bracket 26, as illustrated in FIG. 4. That is, an end projection 80 extends beyond the body 74 in a cantilever arrangement, and is adapted insert and lock into an opening 106 in the support post 102. The remaining projections 76 insert into respective openings 106 in the post 102. This arrangement provides positive engagement of the surface mounting bracket 72 with the support post 102 and positive engagement of the bracket 72 with the display 22, to maintain the display 22 affixed to the post 102 and partition wall 104. As shown in FIGS. 5 and 6, the display portion can be fitted with finishing elements 24 to provide a finished look to the display 22. Alternately, the display 22 can be used without the finishing elements.

Figures 8, 9:
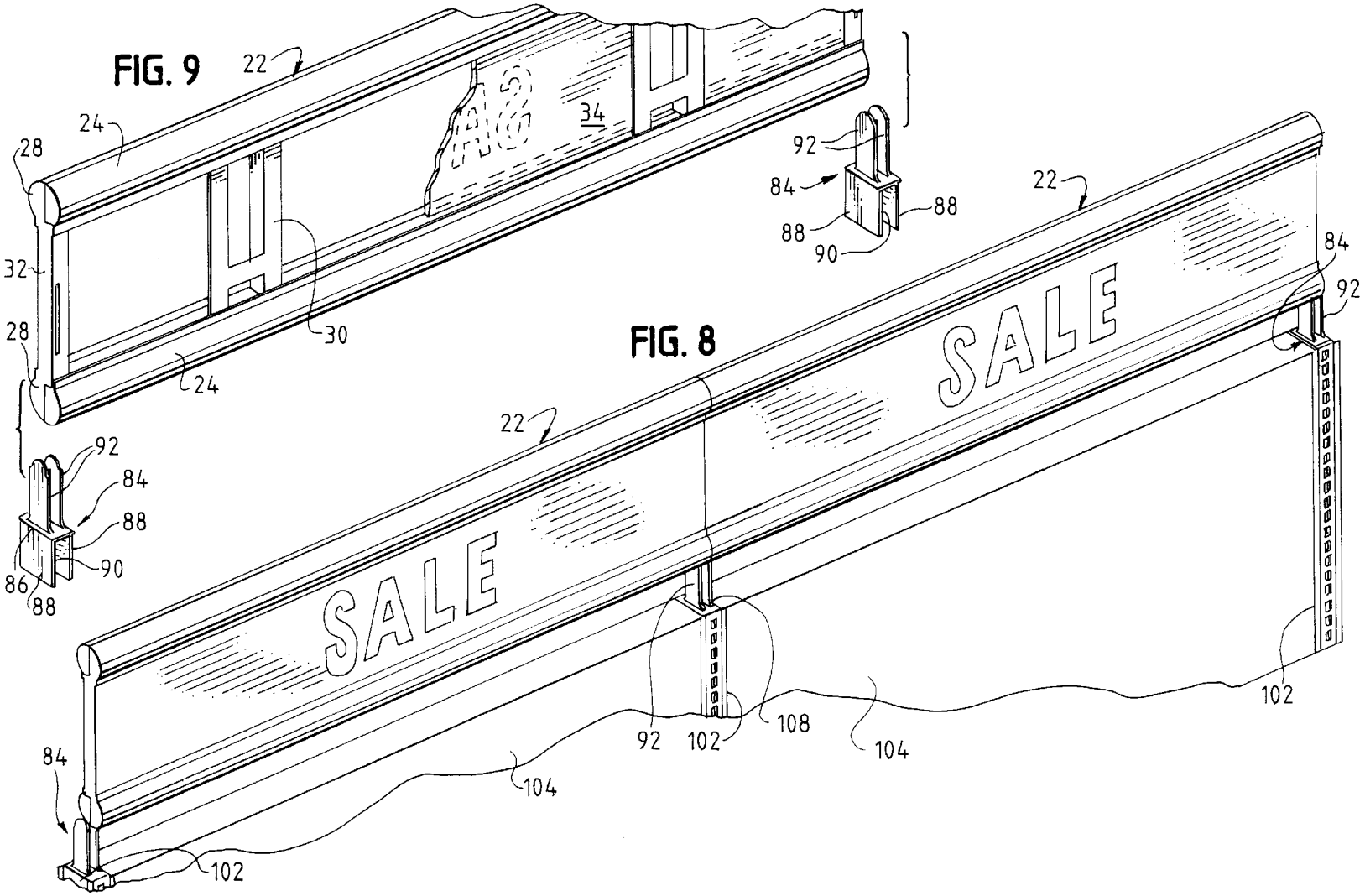
FIG. 8 is a perspective illustration of the tri-mount sign system with a pair of signs mounted in side-to-side relation to one another, atop a partition wall system.
FIG. 9 is an exploded perspective view of one of the signs of FIG. 8 illustrating the partition wall top mounting brackets.

Referring now to FIGS. 8 and 9, there is shown still another mounting arrangement for the tri-mount display system. In this arrangement, the display portion 22 is mounted to the top of the partition walls 104 described above. The support posts 102 generally include an open top 108 covered with a top cap portion (not shown). As illustrated in FIG. 9, a partition wall top mounting bracket 84 is inserted into the top 108 of each post 102 (replacing the cap).

The wall top bracket 84 includes a main body 86 having a pair of spaced-apart retaining legs 88 that may be connected to one another by a crossmember 90. The legs 88 insert into the support post 102. At least one, and preferably a pair of upwardly extending mount elements 92 extend from the body 86. The mount elements 92 insert into openings or notches 66 that are provided in the display portion 22 at about the bottom thereof. The finishing elements 24 can also include corresponding openings to accommodate the mount elements 92.

In a preferred embodiment, the wall top mounting brackets 84 each include a pair of upwardly extending mount elements 92 and each element 92 is configured to engage a display portion 22. In this manner, as illustrated in FIG. 8, the displays 22 can be mounted in side-to-side relation with a single mounting bracket 84 used to support the pair of side-to-side displays 22. Preferably, the wall top mount bracket 84 is friction fitted into both the support post 102 as well as the display portion 22.

The display system 22 can be fabricated from a variety of materials using a variety of forming methods and processes. A presently contemplated display system 10, including the display portion 22, the shelf bracket 26 and the wall surface and top brackets 72, 84 are formed from using an injection molding process. These materials provide strength and lightweight in cost effective display "package". It will however be recognized by those skilled in the art that other materials and methods can be used to fabricate the system 10, which other materials and methods are within the scope of the present invention.

From the foregoing, it will be observed that numerous modifications and variations can be effectuated without departing from the true spirit and scope of the normal concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A mounting system for mounting a sign to a shelf system, the shelf system including at least a pair of support posts and a shelf extending transverse to the support posts, the mounting system comprising:

a display portion having first and second generally parallel, spaced apart runners connected to one another by a pair of spaced apart connecting members defining a sign receiving region, the display portion including at least one of a shelf mounting bracket receiving region, a wall surface mounting bracket receiving region and a wall top mounting bracket receiving region, the shelf mounting bracket receiving region including a mounting portion for mounting the display portion to a shelf mounting bracket, the wall surface mounting bracket receiving region including an elongated opening in at least one of the connecting members intermediate the runners, the opening extending along a portion of the connecting member and adapted to receive a wall surface mounting bracket, the wall top mounting bracket receiving region including a notch in one of the runners at an end thereof, the notch extending along a portion of the runner, the notch adapted to receive a wall top mounting bracket; and at least one of the shelf mounting bracket for mounting the display portion to the shelf, the wall surface mounting bracket for mounting the display portion to the support posts and the wall top mounting bracket for mounting the display portion to the support posts, the shelf mounting bracket including a shelf rest for resting on the shelf, the shelf rest including engaging projections for engaging the shelf and a hinge pivotally mounting the shelf mounting bracket to the display portion for pivoting the display portion between the first and second position, wherein one of the connecting members includes a tab and wherein the shelf mounting bracket includes a display engaging member for engaging the tab for releasably locking the display portion in the first position, the tab and display engaging, member being releasable from one another to pivot the display portion to the second position.

2. The mounting system in accordance with claim 1 wherein the hinge is formed on a hinge arm extending from the rest, generally transverse thereto.

3. The mounting system in accordance with claim 1 wherein the hinge is operably connected to the display portion at one of the first and second runners.

4. The mounting system in accordance with claim 1 wherein at least one of the rest engaging projections is a locking projection adapted to insert and lock into an opening in the shelf to define a cantilever retaining arrangement.

5. The mounting system in accordance with claim 1 wherein the shelf mounting bracket includes a shelf hook for releasably locking shelf mounting the bracket to the shelf.

6. The mounting system in accordance with claim 1 wherein the display engaging member extends through an opening formed in the connecting member.

7. The mounting system in accordance with claim 1 including a finishing element mounted to one of the runners.

8. A mounting system for mounting a sign to a shelf, the shelf including a plurality of openings through a surface thereof and including a lip depending from the surface extending transverse thereto, the mounting system comprising:

a display portion having first and second generally parallel, spaced apart runners connected to one another by a pair of spaced apart connecting members defining a sign receiving region, the display portion including a shelf mounting bracket receiving region; and a shelf mounting bracket for pivotally mounting the display portion to the shelf, the shelf mounting bracket including a shelf rest the shelf mounting bracket including a shelf hook extending from the rest, the hook adapted to engage the lip depending from the shelf to secure the shelf mounting bracket to the shelf.

9. The mounting system in accordance with claim 8 wherein the display portion includes a pivoting element for pivotally mounting the display portion to the shelf mounting bracket, the display portion pivoting between a first position and a second position, wherein the display portion is maintained in the first position by releasable engagement of the display portion with the shelf mounting bracket.

10. The mounting system in accordance with claim 8 wherein the shelf mounting bracket includes a shelf rest having at least one projection extending therefrom generally transverse thereto for locking engagement with the openings in the shelf.

11. The mounting system in accordance with claim 8 wherein the shelf mounting bracket includes a hinge arm extending generally transverse to the rest and including a hinge at about an end thereof, the hinge pivotally connecting the display portion to the bracket.

12. A mounting system for mounting a sign to a shelf, the shelf including a plurality of openings through a surface thereof and including a lip depending from the surface extending transverse thereto, the mounting system comprising:

a display portion;

a shelf mounting bracket for pivotally mounting the display portion to the shelf, wherein the display portion includes first and second generally parallel, spaced apart runners connected to one another by a pair of spaced apart connecting members defining a sign receiving region, the display portion including a shelf mounting bracket receiving region, the display portion further including a pivoting element for pivotally mounting the display portion to the shelf mounting bracket, the display portion pivoting between a first position and a second position, wherein the display portion is maintained in the first position by releasable engagement of the display portion with the shelf mounting bracket, wherein one of the connecting members includes a tab and wherein the shelf mounting bracket includes a display engaging member for engaging the tab for releasably locking the display portion in the first position, the tab and display engaging member being releasable from one another to pivot the display portion to the second position.

13. A sign mounting system for mounting a sign to an associated shelf, comprising:

a frame for supporting the sign; and a mounting bracket for pivotally mounting the frame to the shelf, the frame being rotatable about the bracket between a first position and a second position, and being releasably, lockingly engageable in the first position, the bracket including a frame engaging member for lockingly engaging the frame in the first position and a shelf engaging portion for maintaining the bracket in engagement with the shelf, the bracket including a hinge about which the frame rotates, the hinge being spaced from the frame engaging member, wherein the frame engaging member is in spaced relation to an axis of rotation about which the frame rotates.

14. The sign mounting system in accordance with claim 13 wherein the shelf engaging portion includes a plurality of projections extending from the mounting bracket adapted to traverse through the shelf and affect a cantilever locking arrangement.

15. The sign mounting system in accordance with claim 14 wherein the shelf engaging portion further includes a shelf hook.

16. A mounting system for mounting a sign to an associated shelf, the shelf including a plurality of openings through a surface thereof and including a lip depending from the surface extending transverse thereto, the mounting system comprising:

a display portion having first and second generally parallel, spaced apart runners connected to one another by a pair of spaced apart connecting members defining a sign receiving region, the display portion including a shelf mounting bracket receiving region; and a shelf mounting bracket for mounting the display portion to the shelf, the shelf mounting bracket including a shelf rest mounting bracket including a shelf hook extending from the rest, the hook adapted to engage the lip depending from the shelf to secure the shelf mounting bracket to the shelf, the mounting bracket further including a plurality of engaging projections for inserting into the openings in the shelf and securing the bracket thereto.

17. The mounting system in accordance with claim 27 wherein a plurality of the engaging projections are locking projections.

18. The mounting system in accordance with claim 27 wherein the locking projections are spaced from the shelf hook.

* * * * *